US007324778B2

(12) United States Patent
Suzuki et al.

(10) Patent No.: US 7,324,778 B2
(45) Date of Patent: Jan. 29, 2008

(54) FIXING DEVICE INCLUDING HEATING ROLLER AND PRESSURE ROLLER

(75) Inventors: Takashi Suzuki, Ibaraki (JP); Teruaki Mitsuya, Ibaraki (JP); Keisuke Kubota, Ibaraki (JP); Masato Miwa, Ibaraki (JP); Yoshitaka Fujinuma, Ibaraki (JP); Tsutomu Nakagawa, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 287 days.

(21) Appl. No.: 11/171,434

(22) Filed: Jul. 1, 2005

(65) Prior Publication Data

US 2006/0002749 A1 Jan. 5, 2006

(30) Foreign Application Priority Data

Jul. 2, 2004 (JP) ..... P2004-196627

(51) Int. Cl.
*G03G 15/20* (2006.01)

(52) U.S. Cl. ..... 399/328; 399/333

(58) Field of Classification Search ..... 399/328, 399/330, 331, 333
See application file for complete search history.

(56) References Cited

U.S. PATENT DOCUMENTS

| | | | | |
|---|---|---|---|---|
| 6,009,300 | A * | 12/1999 | Kagawa et al. | 399/333 |
| 6,101,346 | A * | 8/2000 | Arakawa | 399/330 |
| 6,438,348 | B2 * | 8/2002 | Kobaru et al. | 399/333 |
| 6,728,507 | B2 * | 4/2004 | Yamamoto et al. | 399/333 |
| 6,985,689 | B2 * | 1/2006 | Nanataki et al. | 399/328 |

* cited by examiner

*Primary Examiner*—William J. Royer
(74) *Attorney, Agent, or Firm*—McGinn IP Law Group, PLLC

(57) ABSTRACT

A fixing device wherein supposing that the total load given to a heating roller and a pressure roller is W (kgf) and the area of the pressure contact portion of the heating roller with respect to the pressure roller (nip area) is S ($cm^2$), the nip pressure (=W/S) is 2.7 $kgf/cm^2$ or more and the length of the pressure contact portion in the direction parallel to the direction of conveyance of a recording material is defined to be 14 mm or more.

6 Claims, 1 Drawing Sheet

FIXING DEVICE INCLUDING HEATING ROLLER AND PRESSURE ROLLER

BACKGROUND OF THE INVENTION

1. Field of the Invention

The present invention relates to a fixing device for use in an image forming apparatus such as a laser printer and a copier.

2. Description of the Related Art

As a fixing device adapted to fix an unfixed developed image which has been transferred onto a recording material in an image forming apparatus such as a laser printer and a copier there is known a fixing device which is arranged to apply heat and pressure to a recording material while being conveyed and nipped between a pair of rollers, i.e., a heating roller and a pressure roller which are brought into pressure contact with each other so that the unfixed developed image is fixed to the recording material.

SUMMARY OF THE INVENTION

A related art fixing device will be described hereinafter in connection with FIG. 2. The surface temperature of a heating roller 4 is controlled to a predetermined value by allowing a temperature controller which is not shown to control a heater lamp 7 incorporated in the heating roller 4.

A pressure roller 5 is brought into pressure contact with the heating roller 4 by a spring to form a pressure contact portion (nip portion) 6. L2 represents a crosswise length of the nip portion 6. When a recording material 2 having a toner image 3 retained thereon is passed through the nip portion 6, the toner image 3 is fixed to the recording material 2 by heat and pressure energy.

The heating roller 4 has a diameter of 70 mm and comprises a metal core 10 made of aluminum (A5052 material) having a thickness of 5 mm.

The surface of the heating roller 4 is covered by a silicon rubber to a thickness of 30 μm as a rubber layer 11. The hardness of the surface rubber layer 11 is 20 degrees according to JIS A hardness. The pressure roller 5 has a diameter of 70 mm and comprises an iron core 12 covered by a silicon rubber having a hardness of 30 degrees according to JIS A rubber hardness to a thickness of 7 mm as a rubber layer 11. The surface of the silicon rubber layer 11 is covered by a fluororesin layer 13 to a thickness of 50 μm.

Disposed above the heating roller 4 is a cleaner 8 adapted to spread an offset inhibitor (dimethyl silicon oil) over the heating roller 4 while cleaning the surface of the heating roller 4. In accordance with the above-configuration, the printing speed is 70 sheets/min (300 mm/s) and the temperature of the heating roller 4 is controlled to 180° C.

In the fixing device, the pressure contact load is predetermined to 50 kgf, the length of the pressure roller 5 is 300 mm, and the width of the nip portion 6 is 8 mm (on the average). Accordingly, the contact pressure on the nip portion 6 is 2.08 kg f/cm$^2$. Referring to the course of the fixing device, the toner image 3 which has been transferred onto the recording material 2 is inserted into the nip portion 6 while being supported by a fixing inlet guide. In the nip portion 6, the toner image 3 is heated under pressure so that it is fixed to the recording material 2 which is then discharged.

The fixing device is an example in a color printer. In order to fix a toner image in a single layer to four layers for a color image, a rubber layer having a thickness of scores of micrometers is needed. The toner used herein is a sharp melt type ground polyester toner (glass transition point Tg: 65° C.). Development involves a two-component development process. Thus, the toner image which has been developed by a developing device is then transferred onto the recording material by a transferring roller.

The fixing device is subjected to experiment with the amount of toner transferred onto the recording material 2 being predetermined to 0.6 mg/cm$^2$ per color (hereinafter referred to as "attached amount"). This attached amount is a value generally known with an imaging device for forming a full-color image. As a method of evaluating the fixability of the toner image 3 to the recording material 2 in the experimental apparatus there is used a method which comprises measuring the amount of the toner image 3 left on the recording material 2 after peeling a scotch tape produced by Sumitomo 3M Co., Ltd. off the toner image 3 having a size of 20 mm square at a predetermined speed. As the recording material 2 to be used in evaluation there is used DSK 135 kgf paper (160 g/m$^2$ paper) produced by Kobayashi Kirokushi Co., Ltd. The controlling temperature of the heating roller 4 is used as a parameter. The results of evaluation are set forth in Table 1 below.

TABLE 1

| Fixing temperature | Number of colors overlapped | | | |
|---|---|---|---|---|
| (° C.) | 1 | 2 | 3 | 4 |
| 160 | Poor | Poor | Poor | Poor |
| 170 | Good | Poor | Poor | Poor |
| 180 | Good | Poor | Poor | Poor |
| 190 | Good | Poor | Poor | Poor |
| 200 | Good | Good | Poor | Poor |
| 210 | Excellent | Good | Poor | Poor |

Excellent: Practicable;
Good: Practicable (no margin);
Poor: Impracticable

As can be seen in the aforementioned results, the fixing roller process is disadvantageous in that when printing is made on a thick paper, the more the number of toner image layers is, the worse is fixability. Further, to avoid trouble the printing speed must be lowered or the controlling temperature of the heating roller 4 must be raised to assure a desired fixability. When the controlling temperature of the heating roller 4 is raised, the life of the heating roller 4 is accordingly shortened and the recording material 2 curls more. At the same time, the margin against wrinkled printing is remarkably lowered.

It is an object of the invention to provide a fixing roller type fixing device having a high reliability which requires neither reduction of printing speed nor rise of the controlling temperature of the fixing roller more than necessary.

According to one aspect of the invention, a fixing device having a heating roller comprising a rubber layer having a thickness of 0.3 mm or more and a fluororesin layer having a thickness of 0.03 mm or more provided on the rubber layer and a pressure roller comprising a rubber layer having a thickness of 12 mm or more which rotates in contact with the heating roller which is adapted to heat and press a recording material having an unfixed developed image retained thereon while being conveyed and clamped between the heating roller and the pressure roller so that the unfixed developed image is fixed to the recording material, wherein supposing that the total load given to the heating roller and the pressure roller is W (kgf) and the area of the pressure contact portion of the heating roller with respect to the pressure roller (nip area) is S ($cm^2$), the nip pressure (=W/S) is 2.7 $kgf/cm^2$ or more, and the length of the pressure contact portion in the direction parallel to the direction of conveyance of the recording material is defined to be 14 mm or more.

By thus configuration, a fixing device having a high reliability can be realized which can provide a stable fixability even in a multi-layer full-color fixing process without reducing the printing speed.

DESCRIPTION OF THE PREFERRED EMBODIMENTS

Figure 1:
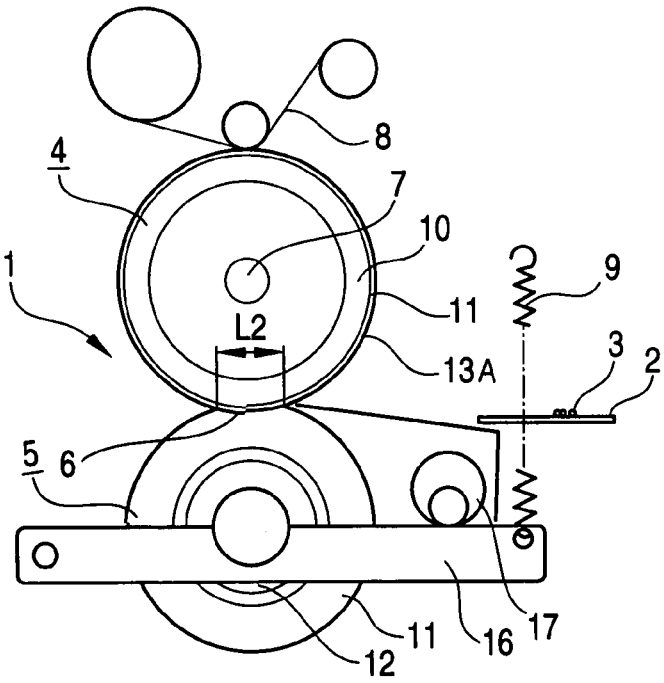
FIG. 1 is a diagram of a fixing device according to an embodiment of the invention.
Figure 2:
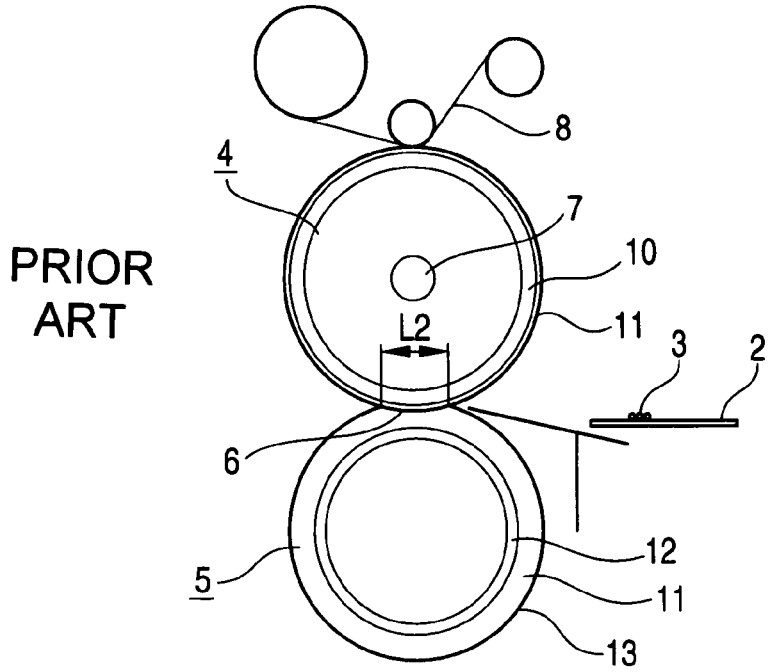
FIG. 2 is a diagram of a related art fixing device.

FIG. 1 is a sectional view of a fixing device 1 according to an embodiment of the present invention. In FIG. 1, a heating roller 4 and a pressure roller 5 are arranged such that they rotate while being brought into pressure contact with each other by a spring 9 to form a nip portion 6. The surface temperature of the heating roller 4 is controlled to a predetermined value by allowing a temperature controller which is not shown to control a heater lamp 7 incorporated in the heating roller 4. When a recording material 2 having a toner image 3 retained thereon is passed through the nip portion 6. the toner image 3 is fixed to the recording material 2 by heat and pressure energy. The heating roller 4 and the pressure roller 5 each have a diameter of 70 mm. The heating roller 4 comprises a core 10 made of aluminum (A5052) having a thickness of 8 mm. The surface of the core 10 is covered by a LTV silicon rubber to a thickness of 0.8 mm (50 degrees according to JIS A hardness) as a rubber layer 11. The rubber layer 11 is covered by a PFA tube 13A to a thickness of 0.15 mm.

The surface hardness of the heating roller 4 is 70 degrees according to Asker C hardness. As the LTV silicon rubber of the rubber layer 11 there is used a high heat conductivity type rubber (0.35 W/m·K). The pressure roller 5 has an iron core 12 covered by a silicon rubber (30 degrees according to JIS A hardness) to a thickness of 16 mm as a rubber layer 11. The surface of the rubber layer 11 is covered by a PFA tube 13A to a thickness of 0.05 mm. Disposed above the heating roller 4 is a cleaner 8 adapted to spread an offset inhibitor (dimethyl silicon oil) over the heating roller 4 while cleaning the surface of the heating roller 4.

In the present example, an experiment is conducted with the printing speed being varied from 300 mm/s to 500 mm/s and the controlling temperature of the heating roller 4 being varied. In the present example, the fixability is confirmed by a tape peeling method with the contact pressure in the nip portion 6 as a parameter with the total load for pressure contact of the heating roller 4 and the pressure roller 5 with each other being varied from 70 kgf to 170 kgf.

The toner used is the same as used in the aforementioned related art example. The development process is the same as used in the aforementioned related art example and the comparison of attached amount of toner is conducted under the same conditions as used in the aforementioned related art example. As the recording material there is used DSK (135 kgf) paper produced by Kobayashi Kirokushi Co., Ltd. as in the aforementioned related art example.

The results of the experiment will be described below. Table 2 indicates the results of evaluation in the case where the worst fixability is shown when the printing speed is varied from 300 mm/s to 500 mm/s at various nip pressures F ($kgf/cm^2$) with the controlling temperature of the heating roller 4 fixed at 180° C., the rubber hardness of the rubber layer 11 of the pressure roller 5 being varied and the nip area S of the nip portion 6 (product L1×L2 ($cm^2$) of the longitudinal length L1 and the crosswise length L2) being fixed.

TABLE 2

| Nip pressure F | Number of colors overlapped | | | |
|---|---|---|---|---|
| ($kgf/cm^2$) | 1 | 2 | 3 | 4 |
| 2.0 | Good | Poor | Poor | Poor |
| 2.3 | Excellent | Good | Poor | Poor |
| 2.5 | Excellent | Excellent | Excellent | Poor |
| 2.7 | Excellent | Excellent | Excellent | Excellent |
| 2.9 | Excellent | Excellent | Excellent | Excellent |
| 3.2 | Excellent | Excellent | Excellent | Excellent |

Excellent: Practicable;
Good: Practicable (no margin);
Poor: Impracticable

As can be verified from the aforementioned experiment, even when the printing speed varies greatly, there is present a range within which the fixability is practicable even at the practicable temperature of the heating roller 4 so far as the nip portion 6 is given a predetermined contact pressure or more. Since a high pressure is applied to the heating roller 4 in the present experiment, From the stand point of reliability, the surface of the rubber layer 11 may be covered by a PFA tube 13A to a thickness of 0.03 mm or more.

The results of evaluation of fixability made similarly with the crosswise width L2 of the nip portion 6 as a parameter when the printing speed and the nip pressure F are predetermined to 400 mm/s and 2.3 $kgf/cm^2$, respectively, are set forth in Table 3.

TABLE 3

| Nip width | Number of colors overlapped | | | |
|---|---|---|---|---|
| (mm) | 1 | 2 | 3 | 4 |
| 8 | Good | Poor | Poor | Poor |
| 10 | Excellent | Good | Poor | Poor |
| 12 | Excellent | Excellent | Excellent | Poor |
| 14 | Excellent | Excellent | Excellent | Excellent |
| 16 | Excellent | Excellent | Excellent | Excellent |
| 18 | Excellent | Excellent | Excellent | Excellent |

Excellent: Practicable;
Good: Practicable (no margin);
Poor: Impracticable

As can be verified from the aforementioned results, when the width of the nip portion 6 is 14 mm or more, a practicable range of multi-layer fixability can be assured. It is confirmed from the results of Tables 2 and 3 that when the nip pressure F is 2.7 kgf or more and the crosswise length L2 of the nip portion 6 is 14 mm or more, an extremely stable fixability can be assured. According to the series of results of evaluation, the rubber hardness of the rubber layer 11 may be 35 degrees or more according to JIS A hardness. The hardness of the surface of the heating roller 4 may be 60 degrees or more according to Asker C hardness.

When such a high pressure is predetermined, it is desirable from the standpoint of fixability that the surface of the heating roller 4 has a fluororesin layer provided thereon to a thickness of 0.02 mm or more. In the pressure roller 5, the thickness of the rubber layer 11 may be 12 mm or more to meet the aforementioned requirements.

A mechanism for releasing pressure contact in the fixing device of the present example will be described below. The pressure roller 5 is fixed to a fixing frame (not shown) via a coupling mechanism and is rotatably driven by a driving mechanism which is not shown. The pressure roller 5 is brought into pressure contact with the heating roller 4 by a spring 9 via a pressure contact arm 16. The pressure contact arm 16 is arranged such that when a nip release cam 17 is rotated by a driving mechanism which is not shown, the pressure roller 5 is brought into or released from pressure contact with the heating roller 4.

The fixing device of the embodiment is arranged to be controlled by a controller which is not shown such that pressure contact is made only during printing (fixing) but is released at other steps.

If the release of pressure contact cannot be automatically effected under the fixing conditions of the embodiment of the invention, the deterioration of the rubber layer 11 proceeds in a short period of time due to the high pressure of the pressure roller 5 against the rubber layer 11, resulting in the pressure roller 5 having an extremely short life. Accordingly, the fixing device of the invention is required to release pressure contact automatically.

Referring to the spring constant of the spring 9 and fixability, the spring constant of the spring 9 may be 5.0 kgf/mm or more taking into account the balance with the deformation of the nip portion 6 between the pressure roller 5 and the heating roller 4. When the thickness of the core 10 of the heating roller 4, if made of aluminum, which has a good heat conductivity, is 6 mm or more, a stable fixability can be assured taking into account the balance with the nip pressure F. The heat conductivity T of the rubber layer 11 of the heating roller 4 may be as high as possible, more preferably 0.3 W/m·K or more.

What is claimed is:

1. A fixing device comprising:

a heating roller including a rubber layer having a thickness of 0.3 mm or more and a fluororesin layer having a thickness of 0.03 mm or more provided on the rubber layer; and a pressure roller including a rubber layer having a thickness of 12 mm or more, the pressure roller rotating in contact with the heating roller which is adapted to heat and press a recording material having an unfixed image retained thereon while being conveyed between the heating roller and the pressure roller so that the unfixed image is fixed to the recording material, wherein supposing that a total load given to the heating roller and the pressure roller is W (kgf) and an area of a pressure contact portion of the heating roller with respect to the pressure roller (nip area) is S ($cm^2$), a nip pressure (=W/S) is 2.7 $kgf/cm^2$ or more, and wherein a length of the pressure contact portion in the direction parallel to the direction of conveyance of the recording material is defined to be 14 mm or more.

2. The fixing device according to claim 1, wherein the heating roller exhibits a rubber layer hardness of 35 degrees or more according to JIS A hardness and a surface hardness of 60 degrees or more according to Asker C hardness.

3. The fixing device according to claim 1, wherein a heat conductivity of the rubber layer of the heating roller is 0.3 W/m·K or more.

4. A fixing device comprising:

a heating roller including a rubber layer having a thickness of 0.3 mm or more and a fluororesin layer having a thickness of 0.03 mm or more provided on the rubber layer; and a pressure roller including a rubber layer having a thickness of 12 mm or more, the pressure roller rotating in contact with the heating roller which is adapted to heat and press a recording material having an unfixed image having a plurality of colors retained thereon while being conveyed between the heating roller and the pressure roller so that the unfixed image is fixed to the recording material, wherein supposing that a total load given to the heating roller and the pressure roller is W (kgf) and an area of a pressure contact portion of the heating roller with respect to the pressure roller (nip area) is S ($cm^2$), the nip pressure (=W/S) is 2.7 $kgf/cm^2$ or more, and wherein a length of the pressure contact portion in a direction parallel to the direction of conveyance of the recording material is defined to be 14 mm or more.

5. The fixing device according to claim 4, wherein the heating roller exhibits a rubber layer hardness of 35 degrees or more according to JIS A hardness and a surface hardness of 60 degrees or more according to Asker C hardness.

6. The fixing device according to claim 4, wherein a heat conductivity of the rubber layer of the heating roller is 0.3 W/m·K or more.

* * * * *